US005985159A

United States Patent [19]

Strid et al.

[11] Patent Number: 5,985,159

[45] Date of Patent: Nov. 16, 1999

[54] METHOD AND DEVICE FOR CONCENTRATING A SUSPENSION

[76] Inventors: Kent Strid, Svadenvägen 11, S-810 28, Järbo; Rolf Oswaldsson, Töregatan 27, S-804 31, Gävle, both of Sweden; Lars Horlyk, Ases vei 161, N-1300, Sanvika, Norway

[21] Appl. No.: 08/809,126

[22] PCT Filed: Sep. 14, 1995

[86] PCT No.: PCT/SE95/01042

§ 371 Date: May 12, 1997

§ 102(e) Date: May 12, 1997

[87] PCT Pub. No.: WO96/08600

PCT Pub. Date: Mar. 21, 1996

[30] Foreign Application Priority Data

Sep. 14, 1994 [SE] Sweden ..... 9403077

[51] Int. Cl.[6] ..... B01D 33/04; B01D 33/052; B01D 33/073; D21F 1/66

[52] U.S. Cl. ..... 210/783; 210/784; 210/400; 210/402; 210/406; 162/56; 162/358.1; 162/368; 100/37; 100/116; 100/121; 100/153

[58] Field of Search ..... 210/400, 401, 210/402, 404, 783, 784, 406; 100/37, 116, 121, 151, 153; 162/56, 358.1, 368

[56] References Cited

U.S. PATENT DOCUMENTS

| | | | |
|---|---|---|---|
| 50,158 | 9/1865 | Eddy . | |
| 838,615 | 12/1906 | Goldman . | |
| 1,595,894 | 8/1926 | Klund . | |
| 2,365,658 | 12/1944 | Schumacher . | |
| 3,878,698 | 4/1975 | Friksson et al. | 100/121 |
| 3,973,483 | 8/1976 | Appenzeller | 100/153 |
| 4,066,548 | 1/1978 | Olson et al. | 210/400 |
| 4,697,511 | 10/1987 | Davis et al. | 210/400 |
| 4,861,495 | 8/1989 | Pietzsch | 210/401 |
| 5,163,364 | 11/1992 | Bubik et al. | 100/153 |
| 5,213,686 | 5/1993 | Funk et al. | 210/402 |
| 5,520,824 | 5/1996 | Sasahi | 210/780 |
| 5,656,165 | 8/1997 | Yamamoto et al. | 210/400 |
| 5,725,783 | 3/1998 | Hoden | 210/400 |

FOREIGN PATENT DOCUMENTS

| | | | |
|---|---|---|---|
| 60-49894 | 3/1985 | Japan | 210/769 |

*Primary Examiner*—Robert J. Popovics
*Attorney, Agent, or Firm*—Quarles & Brady

[57] ABSTRACT

A method for concentrating a suspension comprises the steps of providing a first surface; providing a second surface; introducing a suspension; moving the second surface relative to the first surface; and applying suction to the second surface. The first surface is relatively liquid-tight and includes a feature for increasing friction. The second surface is relatively liquid-pervious, faces the first surface, and is moveable relative to the first surface. Introduction of the suspension between the first and second surfaces forms a suspension web. Moving the second surface relative to the first surface and applying suction through the second surface causes dewatering of the suspension web and increased friction between the suspension web and the second surface. Also, moving the surfaces relative to each other and applying suction through the second surface causes pressing of the first surface towards the suspension web and the second surface to subject the suspension web to shear forces generated by relative movement between the feature for increasing friction and the second surface. This results in the particles of the suspension web being subjected to rolling between the first and second surface.

25 Claims, 3 Drawing Sheets

METHOD AND DEVICE FOR CONCENTRATING A SUSPENSION

Figure 1:
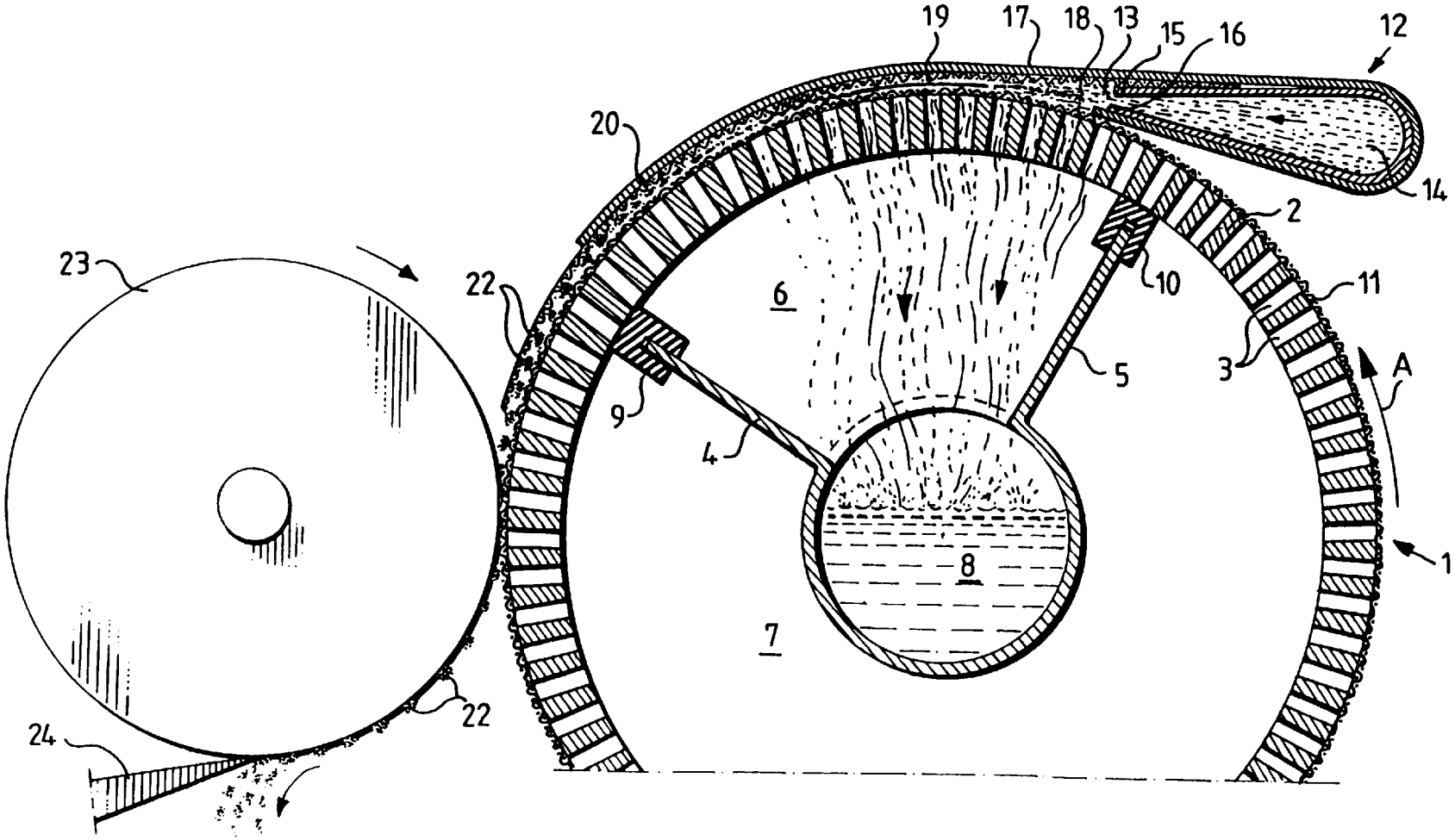

The present invention concerns a method and a device for concentrating a suspension, i.e., increasing the dry contents of the suspension, the suspension during increase of its dry contents moving between a first, relatively tight surface, and a second, relatively pervious surface, through which suction takes place.

The invention also concerns a device for carrying out this method, the device including a first, relatively tight surface and a second, relatively pervious surface, which is movable relative to the first surface, means for forming on the second surface a continuous web of suspension, and means for providing suction through the relatively pervious surface.

The increasing use of recycled fibre pulp involves a need of washing the pulp, i.e., to remove fine-material from the waste paper stock, particularly filler material, such as clay, printing ink and fines. This is achieved by utilizing a diluted suspension which is screened through a wire gauze such that a thin fibre mat having such low grammage that its filtering capability is moderate. In order to achieve sufficient volume capacity the apparatuses have a high operational speed and produce a fibre mat having a relatively high concentration.

Presently, mainly two types of thin film washers are used, viz., "Vario-Split" from Escher-Wyss and "DNT Belt Washer" from Black Clawson.

Vario-Split is based on experiences from the kind of wire part for paper that is called roll former, and the low initial retention these give for fine material. A fibre suspension having a low concentration (0.4–1.5%) is sprayed into the nip between a massive roll and a surrounding wire. Water and accompanying fine material pass through the wire, while larger particles are retained thereon, so that a fibre mat is built up under the wire. The separation of fine particles from the larger ones rapidly becomes less effective during the continued filtration. After an enclosing angle of about 180° the wire is brought back via a system of pulley rolls etc. The fibre web adheres to the roll and is removed by a doctor blade, the pulp then having a dry content of 7–8%. This apparatus works according to the "constant pressure" principle, i.e., that the pressure against the suspension/fibre mat is constant during the entire process.

"DNT washer" exhibits two rolls having equal diameters, one being grooved and the other smooth. The rolls are placed side by side at a centre distance larger than twice the diameters, and are surrounded by a wire having a direction of movement from the top of the grooved roll, down around it, to the smooth roll, up around it and back to the top of the grooved roll. The nozzle of a head box sprays a diluted suspension into the nip between the wire and the grooved roll. Water and fine material pass through the wire in a similar manner as in the "Vario-Split", but the grooves involve a lower pressure against the fibre mat, so that a smaller part of the water is removed during passage around the roll. The grooves cause the pulp web to be thrown off the roll at the nip exit and to follow the wire up to the nip towards the smooth roll. More water and fine material is here pressed out of the pulp. At the outlet from the latter nip, at the top of the smooth roll, the pulp web adheres to the roll and follows it, is removed by a doctor blade, and falls down into a channel parallel to the rolls for discharge by a conveyor screw.

Also this apparatus works according to the "constant pressure" principle, with the exception, however, that there is a first relatively low pressure during the passage of the first roll, and a second, relatively high pressure during the passage of the second roll.

The "constant pressure" principle has as an inherent peculiarity that practically all dewatering occurs at the beginning of the pressing between the wire and the roll, the retained fibres arranging themselves in a static manner which is then not changed during the continued passage and which very rapidly makes the fibre mat so tight that any fine material no longer passes through the wire.

The object of the present invention is to provide a method and device for concentrating a suspension, whereby shall be achieved considerably higher dry contents than has been hitherto possible. The aim shall be that dry contents of up to 40% shall be achieved, and this without the suspension or the suspension web formed shall be exposed to extreme pressures.

Figure 2:
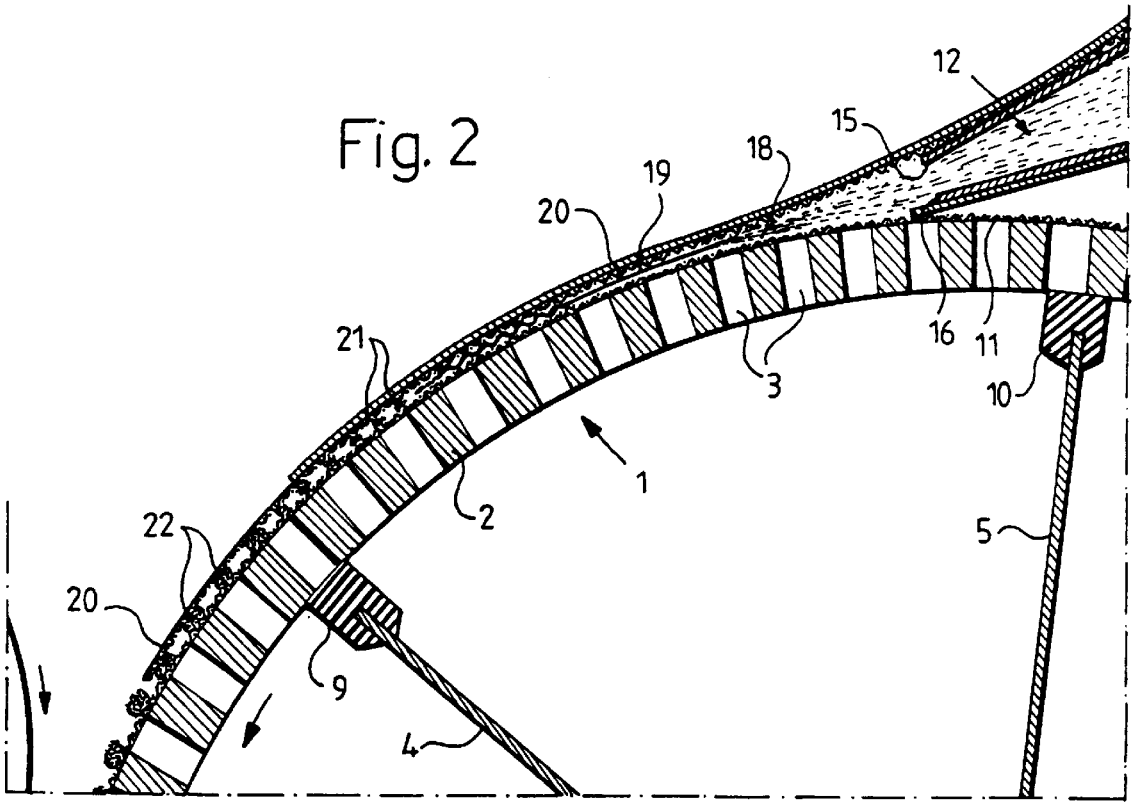
Figure 3:
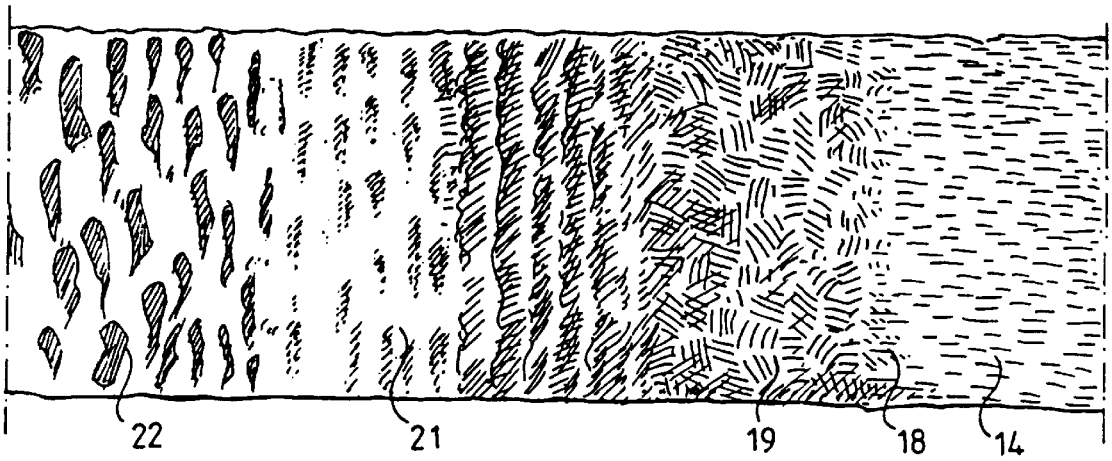
Figure 4:
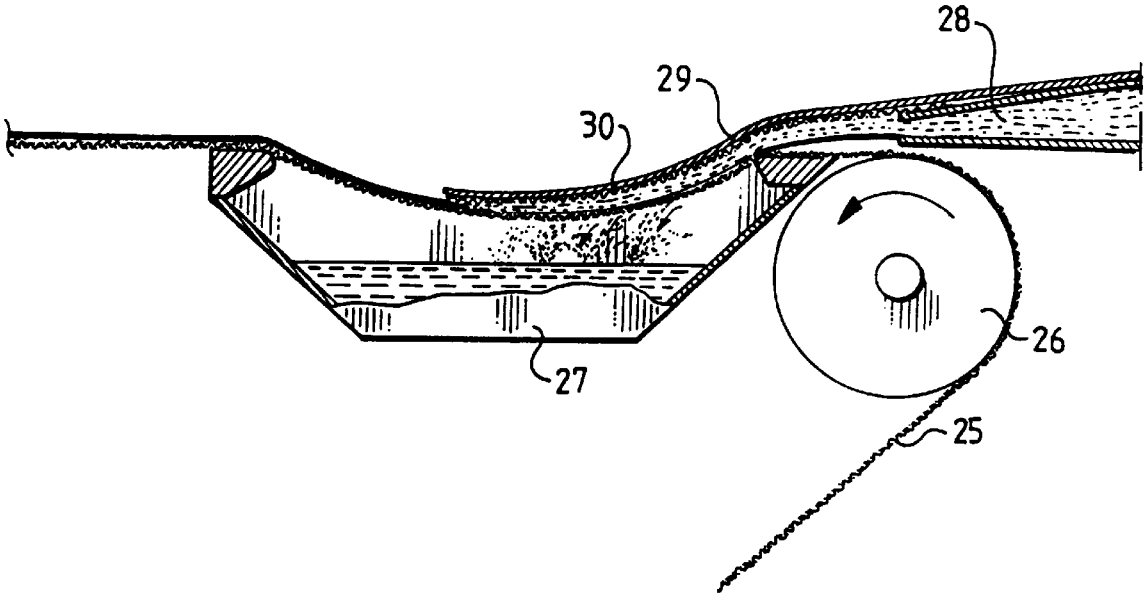

The invention will be described hereinafter, reference being made to the accompanying drawings, wherein FIG. 1 is a schematic cross section through a first embodiment of the invention, FIG. 2 is a detail of FIG. 1 at a larger scale, for the purpose of elucidation having the different phases of the course of transformation of the suspension separately drawn, FIG. 3 is a plane view showing the suspension web with its different phases, and FIG. 4 shows a second embodiment of a device according to the invention.

The device shown in FIG. 1, which constitutes a first example of the application of the invention, includes a rotatable drum 1, the mantle wall 2 of which is provided with a plurality of perforations 3. By means of radially directed shields 4 and 5, the interior of the drum is divided into two separate spaces 6 and 7. The space 6 communicates with a central outlet 8 and can be put under vacuum, for instance by the outlet leading to a non-shown vacuum tube. The shields 4 and 5 are provided with slide seals 9 and 10, respectively, bearing on the inner side of the mantle wall 2 of the drum. A wire cloth 11 is arranged around the circumference of the drum. The rotational direction of the drum is indicated by an arrow A.

An inlet 12 for suspension opens out with a nozzle 13 close to the periphery of the drum, and above and within the sector defined by the shields 4 and 5. The nozzle is arranged to direct a flow of suspension 14 in the rotational direction of the drum towards the wire cloth 11. It is defined by an outer edge 15 and an inner edge 16. A tight, flexible cloth, a so-called foil or upper lip 17, extends from the outer edge in the flow direction of the suspension, i.e., also in the rotational direction of the drum, said upper lip being free to rest on a portion of the circumference of the drum merely by the influence of gravity and/or vacuum produced within the space 6.

As it has so far been described, the device corresponds in all essential to a prior art device for dewatering and/or sheet forming. Thus, when applying a flow of suspension 14 onto the wire cloth 11 during rotation of the drum and having a vacuum in the space 6, a web 18 of suspension is formed on the wire which, during movement in the peripheral direction of the drum, is increasingly dewatered by water being sucked through the wire and the perforations 3 of the drum into the space 6 and out through the outlet 8. Due to the normal force between the suspension web 18 and the wire increasing owing to the suction, also the frictional force therebetween increases. The sheet 19 formed from dewatered suspension obtaines a dry content of at most about 10%.

According to the present invention, means is provided to increase also the friction between the suspension web fed by the wire 11 and the normally relatively smooth underside of the upper lip 17, along which the suspension web is mainly sliding.

Thus, the side of the upper lip facing the suspension web—the underside—is provided with a friction increasing surface. This can be an integral part of the upper lip o, as shown, a separate layer. In the example shown, the friction increasing layer comprises a wire cloth 20 that may be attached to the upper lip or free therefrom, so that it may move independently of the upper lip. An advantage of using a permeable surface layer, such as a wire cloth, is that transportation of water as well as air can take place crosswise of the suspension web.

In consequence of the increase in surface roughness or friction of the upper lip effected according to the present invention, and the increase in friction between the suspension web and the wire cloth 11 due to the suction, possibly completed by increasing friction due to suction also between the wire 20 and the suspension web, the opposed surfaces of the gradually dryer suspension web are subjected to counter-directed forces (shear forces) that break up (crinkle) the sheet formed and dewatered up to a certain dry content, whereupon its particles (fibres) start rolling between the surfaces (i.e. the wires 11 and 20) moving relative to each other. Studies of the course of events by means of a transparent upper lip has revealed that initially separate or few fibres 21 roll together, but that very soon arises a "snowball-effect" involving accumulation of more and more fibres to discrete rolls 22 or "sticks" of fibres that are distinctly separated in the direction of movement. (The direction of movement is the same as the rotational direction of the drum, whereas the rotational direction of each stick is opposite to that of the drum.) Samples taken in connection with these studies have exhibited an amazing increase in dry content: Already when the fibres start rolling, the dry content rises jump-like to about 30%, to be not less than 35 to 40% when the "sticks" are finished.

The explanation of this phenomenon probably resides on one hand in that the continuous and relatively solid sheet (having a relatively great water retaining capacity) is broken up in practically individual fibres (having little water retaining capacity), on the other in that the rolling per se causes water through-off from the rotating fibre bundles due to centrifugal force. Furthermore, it has appeared that a plurality of fibre rolls are not cylindrical, neither are they symmetrical in other respects, but have a varying diameter along their lengths. This results in that a roll tilts in relation to its rolling direction and is subjected to wringing (as when wringing out a dishcloth) and squeezing, a large extent of the water discharge then occurring.

In the embodiment of FIG. 1 the upper lip 17 is shown to terminate at, or—counted in the rotational direction—just before the shield 4, whereas the wire 20 continues a distance further in the rotational direction of the drum. The upper lip 17 and the wire 20 may be jointly or individually movable in the circumferential direction of the drum for adjustment of the sector within which they shall be effective.

After the individual sticks 22 of fibres have left the space between the two wires the rolling ceases and the sticks adhere to the wire 11 of the drum, from where they are taken off by a removing roller 23. Finally, a doctor 24 scrapes the sticks down onto a non-shown conveyor for further treatment.

One may also choose to have the centrifugal force throw the fibre rolls off the drum as soon as they left the space between the wires 11 and 20.

In the embodiment of FIG. 1 the flexible upper lip 17 is shown to extend around the inlet 12 and past its inner edge 16, there to serve as a resilient slide seal against the wire 11. It appears also from FIG. 1 that the wire 11 has reached into the suction sector between the shields 4 and 5 before the suspension is brought onto the wire.

In the embodiment now described, the movable surface through which dewatering occurs has been supported by a perforated roller. However, the present invention is equally applicable to the prior art type of device for dewatering and sheet forming where dewatering occurs through a non-supported wire. An example of such a device is shown in FIG. 4 and includes an endless wire 25 which, from a roller 26 rotating in the direction of arrow B, is brought over a suction box 27, and a nozzle 28 from which a suspension is sprayed onto the wire 25. A flexible upper lip 29 extends from the nozzle 28 a distance over the suction box. According to the present invention, this prior art device is completed by a friction increasing surface on the underside of the upper lip 29, e.g., a wire 30 in a similar manner as has been described for the first embodiment.

The present invention is also applicable to suspensions of other particles in other liquids than suspensions of paper making fibres in water.

We claim:

1. A device for concentrating a suspension, comprising:

a first, relatively fluid-tight surface;

a second, relatively liquid-pervious surface being movable relative to said first surface;

means for applying suction through said second surface to achieve dewatering of a suspension introduced between said first surface and said second surface to form a suspension web and to cause increased friction between said suspension and said second surface wherein said first surface is provided with friction increasing means, said friction increasing means and said second surface, subjecting said suspension web to shear forces resulting from relative movement between said first and second surfaces, said shear forces causing rolling of particles of said suspension web between said surfaces.

2. A device according to claim 1, wherein said first surface comprises a liquid tight, resilient cloth.

3. A device according to claim 2, wherein said first surface is rough.

4. A device according to claim 3, wherein said first surface comprises one liquid tight layer and one liquid permeable layer facing said second surface.

5. A device according to claim 4, wherein said liquid permeable layer extends further in the direction of relative movement of said first surface than said liquid tight layer.

6. A device according to claim 5, wherein said two layers are mutually displaced in the direction of relative movement of said first surface.

7. A device according to claim 6, wherein said two layers together are displaceable in the direction of relative movement of said first surface.

8. A device according to claim 5, wherein said two layers together are displaceable in the direction of relative movement of said first surface.

9. A device according to claim 4, wherein said two layers are mutually displaced in the direction of relative movement of said first surface.

10. A device according to claim 9, wherein said two layers together are displaceable in the direction of relative movement of said first surface.

11. A device according to claim 4, wherein said two layers together are displaceable in the direction of relative movement of said first surface.

12. A device according to claim 2, wherein said first surface comprises one liquid tight layer and one liquid permeable layer facing said second surface.

13. A device according to claim 12, wherein said liquid permeable layer extends further in the direction of relative movement of said first surface than said liquid tight layer.

14. A device according to claim 13, wherein said two layers are mutually displaced in the direction of relative movement of said first surface.

15. A device according to claim 14, wherein said two layers together are displaceable in the direction of relative movement of said first surface.

16. A device according to claim 13, wherein said two layers together are displaceable in the direction of relative movement of said first surface.

17. A device according to claim 12, wherein said two layers are mutually displaced in the direction of relative movement of said first surface.

18. A device according to claim 17, wherein said two layers together are displaceable in the direction of relative movement of said first surface.

19. A device according to claim 12, wherein said two layers together are displaceable in the direction of relative movement of said first surface.

20. A method for concentrating a suspension, including the steps of:

providing a first, relatively liquid-tight surface having a friction increasing means thereon;

providing a second, relatively liquid-pervious surface facing the first surface and being moveable relative thereto;

introducing the suspension between the first and second surfaces to form a suspension web; and, moving the second surface relative to the first surface and applying suction through the second surface to cause de-watering of the suspension web, increased friction between the suspension web and the second surface, and pressing of said first surface towards the suspension web and the second surface to subject the suspension web to shear forces generated by relative movement between said friction increasing means and the second surface, such that particles of said suspension web are subjected to rolling between the first and second surface.

21. The method according to claim 20, wherein said rolling is continued until separate rolls of particles are formed.

22. The method according to claim 21, further comprising the step of wringing said separate rolls of particles.

23. The method according to claim 21, further comprising the step of adhering said rolls to said second the step of subsequently removing said rolls from said second surface.

24. The method according to claim 23, wherein said second surface describes a rotational movement, and wherein said rolls are removed from said second surface by centrifugal force.

25. The method according to claim 20, wherein said suction is applied at a pressure difference of 0.2–0.05 bar.

* * * * *

UNITED STATES PATENT AND TRADEMARK OFFICE

CERTIFICATE OF CORRECTION

PATENT NO. : 5,985,159
DATED : November 16, 1999
INVENTOR(S) : Kent Strid, Rolf Oswaldsson, Lars Horlyk It is certified that error appears in the above-identified patent and that said Letters Patent is hereby corrected as shown below:

Column 6,
Line 20, as amended of February 19, 1999, after the word "second" insert -- surface after completion of rolling and --.

Signed and Sealed this

Sixth Day of November, 2001

*Attest:*

Nicholas P. Godici

*Attesting Officer*

NICHOLAS P. GODICI
*Acting Director of the United States Patent and Trademark Office*